US009879523B2

(12) United States Patent
Brown-Kerr et al.

(10) Patent No.: US 9,879,523 B2
(45) Date of Patent: Jan. 30, 2018

(54) DETERMINING STUCK POINT OF TUBING IN A WELLBORE

(71) Applicant: Halliburton Manufacturing and Services Limited, Leatherhead, Surrey (GB)

(72) Inventors: William Brown-Kerr, Aberdeenshire (GB); Bruce Hermman Forsyth McGarian, Aberdeenshire (GB)

(73) Assignee: HALLIBURTON MANUFACTURING AND SERVICES LIMITED, Leatherhead (GB)

( * ) Notice: Subject to any disclaimer, the term of this patent is extended or adjusted under 35 U.S.C. 154(b) by 237 days.

(21) Appl. No.: 14/764,638

(22) PCT Filed: May 16, 2014

(86) PCT No.: PCT/GB2014/051523

§ 371 (c)(1),
(2) Date: Jul. 30, 2015

(87) PCT Pub. No.: WO2014/184587

PCT Pub. Date: Nov. 20, 2014

(65) Prior Publication Data

US 2015/0369038 A1 Dec. 24, 2015

(30) Foreign Application Priority Data

May 17, 2013 (GB) ..... 1308915.6
Jul. 18, 2013 (GB) ..... 1312866.5
Jul. 19, 2013 (GB) ..... 1312958.0

(51) Int. Cl.
*E21B 47/09* (2012.01)
*E21B 47/00* (2012.01)
(Continued)

(52) U.S. Cl.
CPC ..... *E21B 47/09* (2013.01); *E21B 23/01* (2013.01); *E21B 29/00* (2013.01); *E21B 29/02* (2013.01);
(Continued)

(58) Field of Classification Search
CPC ..... E21B 47/09; E21B 23/01; E21B 29/00; E21B 29/02; E21B 31/20; E21B 47/0006; E21B 47/18
See application file for complete search history.

(56) References Cited

U.S. PATENT DOCUMENTS 3,555,896 A 1/1971 Roberts
3,690,163 A 9/1972 Shannon et al.
(Continued)

FOREIGN PATENT DOCUMENTS

CN 101517191 A 8/2009
GB 2137353 A 10/1984
(Continued)

OTHER PUBLICATIONS

International Search Report and Written Opinion for PCT/GB2014/051523 dated Jun. 30, 2015.
(Continued)

*Primary Examiner* — Yong-Suk Ro
(74) *Attorney, Agent, or Firm* — McDermott Will & Emery LLP

(57) ABSTRACT

An example method includes introducing a string of tubing into a wellbore to perform a primary operation, the string of tubing including at least one sensor for measuring strain and at least one device operatively associated with the at least one sensor. The method further includes translating the string of tubing relative to the wellbore, imparting a load on the string of tubing when the tubing becomes stuck in the wellbore at a stuck point, and thereby generating strain in the
(Continued)

string of tubing above the stuck point. Additionally, the method includes measuring the strain with the at least one sensor, transmitting data indicative of the strain to a surface location with the at least one device, and determining a position of the at least one sensor in the wellbore, as based on the strain, relative to the stuck point.

26 Claims, 7 Drawing Sheets

(51) Int. Cl.

| | |
|---|---|
| ***E21B 23/01*** | (2006.01) |
| ***E21B 29/00*** | (2006.01) |
| ***E21B 31/20*** | (2006.01) |
| ***E21B 29/02*** | (2006.01) |
| ***E21B 47/18*** | (2012.01) |

(52) U.S. Cl.
CPC ..... *E21B 31/20* (2013.01); *E21B 47/0006* (2013.01); *E21B 47/18* (2013.01)

(56) References Cited

U.S. PATENT DOCUMENTS

| | | | |
|---|---|---|---|
| 4,440,019 | A | 4/1984 | Marshall |
| 6,547,016 | B2 | 4/2003 | Wassell |
| 2003/0024702 | A1 | 2/2003 | Gray et al. |
| 2011/0088903 | A1 | 4/2011 | Onadeko et al. |

FOREIGN PATENT DOCUMENTS

| | | | |
|---|---|---|---|
| WO | 2009137537 | A2 | 11/2009 |
| WO | 2011004180 | A2 | 1/2011 |

OTHER PUBLICATIONS

Chinese Office Action from Chinese Patent Application No. 201480020368.2, dated Jul. 3, 2017.

DETERMINING STUCK POINT OF TUBING IN A WELLBORE

BACKGROUND

The present invention relates to a method of determining the point at which a string of tubing has become stuck within a wellbore. The present invention also relates to a string of tubing for performing a primary operation in a wellbore, which includes equipment to facilitate determination of the point at which the tubing has become stuck, should such occur during translation of the tubing relative to the wellbore.

In the oil and gas exploration and production industry, wellbore fluids comprising oil and/or gas are recovered to surface through a wellbore which is drilled from surface. The wellbore is conventionally drilled using a string of tubing known as a drill string, which includes a drilling assembly that terminates in a drill bit. Drilling fluid known as drilling 'mud' is passed down the string of tubing to the bit, to perform functions including cooling the bit and carrying drill cuttings back to surface along the annulus defined between the wellbore wall and the drill string.

Following drilling, the well construction procedure requires that the wellbore be lined with metal wellbore-lining tubing, which is known in the industry as 'casing'. The casing serves numerous purposes, including: supporting the drilled rock formations; preventing undesired ingress/egress of fluid; and providing a pathway through which further tubing and downhole tools can pass. The casing comprises sections of tubing which are coupled together end-to-end. Typically, the wellbore is drilled to a first depth and a casing of a first diameter installed in the drilled wellbore. The casing extends along the length of the drilled wellbore to surface, where it terminates in a wellhead assembly. The casing is sealed in place by pumping 'cement' down the casing, which flows out of the bottom of the casing and along the annulus.

Following appropriate testing, the wellbore is normally extended to a second depth, by drilling a smaller diameter extension of the wellbore through a cement plug at the bottom of the first, larger diameter wellbore section. A smaller diameter second casing is then installed in the extended portion of the wellbore, extending up through the first casing to the wellhead. The second casing is then also cemented in place. This process is repeated as necessary, until the wellbore has been extended to a desired depth, from which access to a rock formation containing hydrocarbons (oil and/or gas) can be achieved. Frequently, a wellbore-lining tubing is located in the wellbore which does not extend to the wellhead, but is tied into and suspended (or 'hung') from the preceding casing section. This tubing is typically referred to in the industry as a 'liner'. The liner is similarly cemented in place within the drilled wellbore. When the casing/liner has been installed and cemented, the well is 'completed' so that well fluids can be recovered, typically by installing a string of production tubing extending to surface.

It is known that the various different types of tubing run into a wellbore can become stuck. For example, a drill pipe can become stuck during the operation to drill and extend the wellbore. Wellbore-lining tubing (casing, liner) can become stuck during deployment into the wellbore and prior to cementing in place. Primary reasons for the tubing becoming stuck include: cave-in of the drilled rock formation; and a condition known as 'differential sticking'. Differential sticking typically occurs when the pressure of the formation being drilled is significantly lower than the wellbore pressure, resulting in a high-contact force being imparted on the tubing, against the wall of the drilled formation. Differential sticking can be a particular problem in deviated wellbores.

The recovery of a tubing which has become stuck in a wellbore can be extremely challenging. Initial efforts to retrieve the tubing typically involve 'jarring' the tubing, by imparting a short duration large axial force on the tubing, and/or by rotating the tubing. However, often this does not work, and so a range of different techniques and equipment have been developed for recovering stuck tubing.

The main techniques which have been developed centre around locating the point at which the tubing is stuck, and then imparting a localised axial and/or rotary force on a joint of the tubing which is located as close as possible to that point. Following release of the joint, the portion of tubing above the joint can be retrieved to surface, and a specialized tool know as a 'fishing tool' run in, to impart a large pull force on the remaining portion of tubing to retrieve it.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
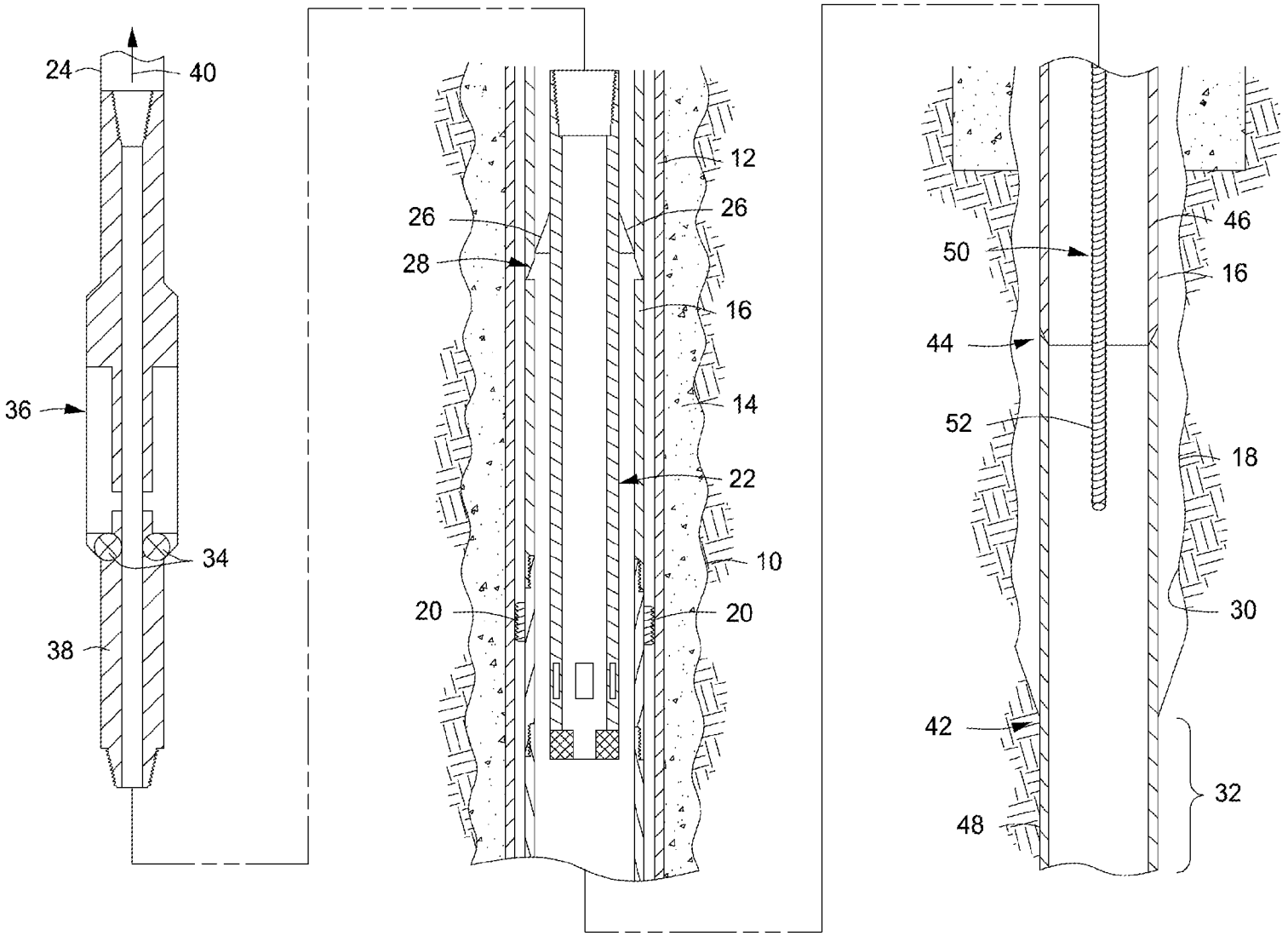
FIG. 1 is a longitudinal sectional view of a wellbore which has been drilled from surface, lined with wellbore-lining tubing in the form of a casing which has been cemented in place, and during a procedure to position a further wellbore-lining tubing in the form of a liner within the wellbore, the drawing showing the liner after it has become stuck, and illustrating steps in a method of determining the point at which the liner has become stuck according to an embodiment of the invention.

In order to recover tubing, it is necessary to locate the 'free point' (or 'stuck point') of the tubing, that is the point at which the tubing is stuck. U.S. Pat. No. 3,690,163 discloses a free point indicator apparatus which can be used for this purpose. However, it requires a separate run of equipment into the wellbore after a tubing has become stuck, which is time-consuming. The apparatus is deployed down the inside of the stuck tubing, and includes two spaced sets of anchors which engage the tubing and which are independently axially moveable relative to one another. A pull force can then be exerted between the two sets of anchors, and the strain between the anchors measured. At a position below the free point, there will be no extension of the tubing, and so no strain measured between the anchors. At a position where the anchors straddle the free point, a strain will result which can be measured and so the free point determined.

U.S. Pat. No. 4,440,019 discloses a free point indicator tool which includes a sensitive coil that is deployed down the inside of the stuck tubing. A pull force is exerted on the tubing at surface. At a position below the free point, there will be no extension of the tubing and so no strain. At a position above the free point, a strain will result. Stressing the free part of the tubing above the free point erases magnetic spots in the tubing, and this can be detected using the tool, and used to determine the free point.

In both cases, the apparatus disclosed in U.S. Pat. No. 3,690,163 and U.S. Pat. No. 4,440,019 require the deployment of specialized equipment into the stuck tubing from surface. This is time-consuming and costly. In both cases, the apparatus blocks the throughbore of the stuck tubing, which is undesirable. Also, the tool of U.S. Pat. No. 4,440,019 cannot be deployed into a deviated wellbore.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

While compositions and methods are described herein in terms of "comprising" various components or steps, the compositions and methods can also "consist essentially of" or "consist of" the various components and steps.

Related equipment has been developed to assist in retrieving stuck tubing. For example, it can be difficult to release a joint in tubing which has been torqued up at surface, and indeed which has been rotated during deployment into a wellbore in the same direction as the make-up direction for the joint. Specialised joints have been developed which release on application of a release force in an opposite direction to the make-up direction of the primary joint. The joints include a second thread which is arranged so that it does not 'torque-up' during use, on rotation of the tubing, for example by means of a friction ring or pin which prevents transmission of torque to the second joint. These joints are intended to release when a sufficiently large release torque is applied, optionally with an explosive charge detonated in the vicinity of the joint. This still requires knowledge of the free point of the tubing in order to be effective.

A wireless pipe recovery system has been developed by Warrior Energy Services, a Superior Energy Services, Inc. company. The system involves a series of decreasing diameter profiles installed in a drill string as it is run in. A drop assembly featuring a pressure activated firing head lands in a specified seat, and jet cuts a sacrificial sub positioned just below the installed seat. Once the sacrificial sub has been cut, the portion of the drill string above the sub can be retrieved, and then the remainder fished out of the hole. Once again, this requires knowledge of the free point of the tubing.

According to a first aspect of the present invention, there is provided a method of determining the point at which a string of tubing has become stuck within a wellbore, the method comprising the steps of: providing a string of tubing for performing a primary operation in a wellbore; providing at least one sensor for measuring strain in the string of tubing; providing at least one device for transmitting strain data to surface and which is operatively associated with said sensor; translating the string of tubing relative to the wellbore, to facilitate performance of the primary operation; and in the event that the tubing becomes stuck so that it cannot be further translated relative to the wellbore, thereby preventing performance of the primary operation: imparting an axial force on the tubing string in an uphole direction, to thereby stimulate strain in the tubing string above the point at which the tubing has become stuck; measuring strain in the tubing in the vicinity of the at least one sensor; and activating the at least one data transmission device, to transmit data to surface indicative of strain in the tubing measured by the at least one sensor, so that a determination of the position of the at least one sensor in the wellbore relative to the stuck point of the tubing can be made.

According to a second aspect of the present invention, there is provided a string of tubing for performing a primary operation in a wellbore, the string of tubing being translatable relative to the wellbore to facilitate performance of the primary operation, in which the string of tubing comprises: at least one sensor for measuring strain in the string of tubing; and at least one device for transmitting data to surface, the device being operatively associated with said sensor; whereby in use and in the event that the tubing becomes stuck so that it cannot be further translated relative to the wellbore, thereby preventing performance of the primary operation: an axial force can be imparted on the tubing string in an uphole direction, to thereby stimulate strain in the tubing string above the point at which the tubing has become stuck; the strain in the tubing in the vicinity of the at least one sensor can be measured employing said sensor; and the at least one data transmission can be activated, to transmit data to surface indicative of strain in the tubing measured by the at least one sensor, so that a determination of the position of the at least one sensor in the wellbore relative to the stuck point of the tubing can be made.

The method (and tubing) of the invention effectively facilitates the determination of the location of a stuck point of a tubing string which has been run-in to a wellbore without requiring the deployment of separate tubing into the wellbore from surface, as is the case with prior apparatus and methods. This is because the at least one sensor and at least one data transmission device are run-in to the wellbore together with the tubing string, and so can be employed to determine the stuck point of the tubing in the event that a problem occurs. The location of the sensor relative to the tubing string is known, and the approximate depth of the sensor within the wellbore is also known (employing conventional techniques which are well known to the skilled person). Accordingly, the presence of strain in the tubing in the vicinity of the at least one sensor enables determination of the approximate position (depth) of the stuck point in the well bore.

Further features of the method and/or tubing of the first and second aspects of the invention may be derived from the following text. Where reference is made specifically to the method of the invention, it will be understood that such text may also relate to corresponding apparatus features of the tubing (and vice-versa).

The strain in the tubing string may be that which results from an axial load applied to the tubing string; a rotational or torsional load applied to the tubing string; or a combination of the two.

The at least one sensor and the at least one data transmission device may be provided in the string of tubing which is to perform the primary operation.

The string of tubing may be a primary tubing string, for performing the primary operation, and the method may comprise providing the at least one sensor and the at least one data transmission device in a secondary string of tubing which is coupled to the primary tubing string, the secondary tubing string employed to translate the primary tubing string relative to the wellbore.

In the event of the primary tubing string becoming stuck, the method may comprise:

a) releasing the secondary tubing string from the primary tubing string;
b) translating the secondary string relative to the primary tubing string so that part of the secondary string resides within the primary tubing string;
c) activating first and second axially spaced anchors of the secondary tubing string provided in the part of the secondary tubing string located within the primary tubing string, to recouple and anchor the secondary tubing string to the primary tubing string;
d) arranging the first and second anchors so that relative axial movement of the anchors is possible;
e) positioning the at least one sensor between the first and second anchors;
f) arranging the anchors and said sensor so that relative axial movement between the anchors results in a strain in the secondary tubing string which can be detected by the sensor, to thereby determine the stuck point of the primary tubing string; and
g) imparting an axial pull force on the secondary tubing in an uphole direction.

In the event that no strain is detected by the sensor, then this is indicative that the first and second anchors are both below the stuck point of the primary tubing, where no movement of the primary tubing occurs (and so no relative axial movement between the first and second anchors, and thus no strain in the secondary tubing string). The method may then comprise releasing the anchors from the primary tubing string, translating the secondary tubing string in an uphole direction, and then repeating steps c) to g). These steps may be repeated as necessary until a strain in the secondary tubing string between the anchors is detected, which is indicative of one of the anchors being above the stuck point and one below the stuck point.

The method may comprise operating a tubing recovery system provided as part of the tubing string, to recover the part of the tubing string located above the stuck point, or at least a portion of said part of the tubing string. The method may comprise: positioning a restriction of the tubing recovery system in a bore of the tubing string running a release device into the tubing string and landing the device on the restriction; and activating the release device to separate the part of the tubing string uphole of the restriction from the part of the tubing string downhole of the restriction.

The uphole part can then be recovered to surface and the downhole part subsequently retrieved from the wellbore, such as via a fishing tool. The restriction may describe an internal diameter which is less than a diameter of the bore of the tubing string. The restriction may be a seat defining a seat surface which receives the release device. The release device may be arranged to direct a jet of cutting fluid on to the tubing string to sever the string. The method may comprise providing the tubing string with a sacrificial section, and arranging the release device to direct the jet of cutting fluid on to the sacrificial section.

The method may comprise positioning a plurality of restrictions of the tubing recovery system in a bore of the tubing string, the restrictions being spaced out along a length of the tubing string. The restrictions may define progressively increasing dimension restrictions, in a downhole direction. The method may comprise selecting a release device which is dimensioned to cooperate with a selected one of the plurality of restrictions, deploying the selected device into the tubing string, and landing the device on the selected restriction. This may facilitate severing of the tubing string at a desired location, appropriate to the particular stuck point of the tubing string.

The method may comprise running a tubing recovery system into the tubing string, to recover the part of the tubing string located above the stuck point, or at least a portion of said part of the tubing string. The method may comprise: running a tubing severing device into the tubing string; locating the tubing severing device at a position where the tubing string is to be severed; and activating the tubing severing device so that a part of the tubing string located uphole of the position where the tubing string has been severed can be separated from the part of the tubing string downhole of said position.

The method may comprise providing the tubing string with a sacrificial section, and activating the tubing severing device to sever the sacrificial section. The tubing string may be provided with an inner sacrificial sleeve and an outer sleeve which together form part of the string. The outer sleeve may serve for transmitting torque and may have a joint which can be axially separated on severing of the sacrificial inner sleeve. The inner sleeve may be of a material which is of a lower hardness than a material of the outer sleeve so that the inner sleeve is severed when the tubing severing device is activated. The inner sleeve may be suitable for or intended to support or transmit axial loads (weight). The outer sleeve may be suitable for or intended to support or transmit rotational loads (torque). The tubing severing device may be or may comprise an explosive charge.

The method may comprise providing the tubing string with at least one release assembly which can be selectively operated to release part of the tubing uphole of the release assembly from a part which is downhole of the release assembly. The release assembly may be a releasable joint assembly having a body with first and second threads at corresponding first and second ends for coupling the joint to sections of the tubing string, and a releasable joint disposed between the first and second ends and which is arranged so that it can be selectively released on application of a release torque. The method may comprise providing a plurality of releasable joint assemblies along a length of the tubing string. This may facilitate release of a part of the tubing located above a stuck point.

The primary operation may be a wellbore drilling operation in which a wellbore is drilled and extended using the tubing string. The string of tubing which is to perform the primary operation may be a drill string having a drilling assembly provided at a downhole end of the tubing string, the drilling assembly comprising a drill bit, at least one sensor and at least one data transmission device. It may be advantageous to provide the sensor and data transmission device as part of the drilling assembly, as the stuck point of a drill string is often found in the region of the drilling assembly.

The primary operation may be a wellbore-lining operation, involving positioning the tubing string in the wellbore where it lines at least part of a wall of the drilled wellbore wall. The tubing string may be a wellbore-lining tubing, which may be casing, liner, sandscreen or the like.

The primary operation may be a workover or intervention operation, which may be performed subsequent to lining and cementing of the wellbore. The tubing string may be a workover or intervention tubing string, used to deploy a workover or intervention tool into the wellbore.

The method may comprise rotating at least part of the tubing string during translation of the tubing string.

The secondary tubing string may be a tubing running string coupled to the primary tubing string, and which is used to deploy the primary tubing string into the wellbore, and to translate the primary tubing string relative to the wellbore.

The data may be transmitted to surface via fluid pressure pulses, and the data transmission device may be a device for generating a fluid pressure pulse downhole. The method may comprise directing a fluid into the wellbore along the tubing string, and may employ the flowing fluid to transmit the data to surface, by way of fluid pressure pulses. Operation of the pulse generating device requires the flow of fluid in the wellbore (typically down through the tubing string and back up to surface along the annular region between the tubing and the wellbore wall). Fluid flow may be prevented in certain circumstances, particularly if there has been a formation collapse. Thus, in the event that no pulses are detected at surface after the pulse generating device has been activated, this may be indicative that the device is below the stuck point, fluid flow past the stuck point along the annular region being prevented.

The device for generating a fluid pressure pulse may be located at least partly (and optionally wholly) in a wall of the tubing string, and may be a device of the type disclosed in the applicant's International Patent Publication No. WO-20111004180. A pulse generating device of this type is a 'thru-bore' type device, in which pulses can be generated without restricting a bore of tubing associated with the device. This allows the passage of other equipment, and in particular allows the passage of balls, darts and the like for the actuation of other tools/equipment and the release device(s), if provided. Data may be transmitted by means of a plurality of pulses generated by the device, which may be positive or negative pressure pulses.

The data may be transmitted to surface acoustically, and the data transmission device may be or may take the form of an acoustic data transmission device. The device may comprise a primary transmitter associated with the at least one sensor, for transmitting the data. The method may comprise positioning at least one repeater uphole of the primary transmitter, and arranging the repeater to receive a signal transmitted by the primary transmitter and to repeat the signal to transmit the data to surface.

The tubing string may be made up from a series of lengths or sections of tubing coupled together end-to-end. However, the invention has a utility with continuous lengths of tubing, such as coiled tubing.

Turning firstly to FIG. 1, there is shown a wellbore 10 which has been drilled from surface and lined with wellbore-lining tubing in the form of a casing 12 which has been cemented in place, as indicated by reference numeral 14. The wellbore 10 is shown during a procedure to position a further wellbore-lining tubing in the form of a liner 16 within the wellbore, the liner extending from the casing 12 into an unlined portion (or "open-hole" portion) 18 of the wellbore 10. As is well known in the art, the liner 18 is to be suspended or "hung" from the casing 12 using hydraulically activated slips 20, and then sealed using a sealing device in the form of a liner top packer (not shown).

The liner 16 is run into the wellbore 10 suspended from a liner hanger running tool 22 provided on the end of a string of drill tubing 24, which includes a number of lengths of drill pipe coupled together end-to-end. The liner hanger running tool 22 includes locking elements in the form of dogs 26, which engage a profile 28 formed on the inside of the liner 16, so that the liner can be suspended from the liner hanger running tool Once the liner 16 has been located at the required position and the slips 20 activated, the locking dogs 26 can be released and the running tool 22 pulled back uphole, to engage the locking elements 26 on an upper end of the liner (not shown), so that a force can be exerted on the liner 16 to set the liner top packer. This might involve the application of weight (an axial load) and/or torque to the top of the liner 16.

The liner 16 is shown in FIG. 1 during run-in to the unlined wellbore portion 18, and prior to location at the required depth. As can be seen in the right hand part of FIG. 1, a wall 30 of the unlined wellbore portion 18 has collapsed in a zone 32, trapping the liner 16 and preventing further translation of the liner, so that it cannot be translated further down the unlined wellbore portion 18 for location at the required depth. Rotation of the liner 16 is also restricted. Whilst the example of a wellbore collapse is shown and described in FIG. 1, it will be understood that other situations may lead to the liner 18 becoming stuck, in particular differential sticking.

The present invention relates to a method of determining the point at which a string of tubing, in this case the liner 16, has become stuck within the wellbore 10. Determination of the stuck point of the liner 16 enables remedial steps to be taken to recover the liner, as will be described in more detail below.

In the method of the invention, a string of tubing is provided for performing a primary operation in the wellbore 10, in this case the liner 16, which is for lining the open-hole portion 18 of the wellbore. The method involves providing at least one sensor 34 for measuring the strain in the liner 16, and a device 36 for transmitting strain data to surface, which is operatively associated with the sensor 34. In the illustrated embodiment, a data transmission device in the form of a device for generating a fluid pressure pulse is provided, which is of the type disclosed in the applicant's International patent publication number WO2011/004180. A plurality of strain sensors are provided, typically three or four sensors, and the sensors are mounted in a tubular member 38 which is coupled to the drill pipe and forms part of drill string. The sensors 34 are spaced around a circumference of the tubular member. It will be understood however that the strain sensors may be provided elsewhere, for example in the liner hanger running tool 22, or in a section of the drill pipe 24.

When the liner 16 becomes stuck so that it cannot be further translated and/or rotated, preventing performance of the primary operation (lining of the portion 18 of the wellbore 10), the method of the present invention involves the application of an axial force on the liner 16 in an uphole direction, as indicated by the arrow 40. This axial force is transmitted through the string of drill pipe 24, tubular member 38, liner hanger running tool 22 and dogs 26 to the liner 16. As the liner 16 is stuck at a point 42 in the zone 32 where the wellbore 10 has collapsed, application of the axial force in the direction 40 stresses the liner 16, with a resultant strain generated in the portion of the liner 16 above the stuck point 42. As the tubular member 38 is connected to the liner 16, via the liner hanging running tool 22, the strain in the liner 16 is also felt by the tubular member 38 of the data transmission device. Accordingly, the strain sensors 34 mounted in the tubular member 38 can be used to measure the strain in the liner 16. The fluid pulse generating device 36 can then be activated, to transmit data to surface indicative of the strain in the liner 16 (measured by the sensors 34) to surface, so that a determination of the position of the sensors 34 in the wellbore 10 relative to the stuck point 42 of the liner 16 can be made. Specifically, as the sensors 34 are located above the stuck point 42, the axial load in the uphole direction 40 generates strain in the liner 16, felt by the sensors 34, as described above. It is therefore known that the sensors 34 are positioned above the stuck point 32.

Whilst reference is made in the preceding paragraph to strains induced in the liner 16 by the application of an axially directed force, it will be understood that strain may additionally or alternatively result from application of a rotational or torsional load, by attempted rotation of the stuck liner. Similar comments apply in terms of resultant strain in the liner 16, as the liner is prevented from rotating below the stuck point 42 (so that no strain results in that portion of the liner), whereas the portion of the liner above the stuck point experiences strain resulting from the applied torsional load.

FIG. 1 shows a joint 44 in the liner 16, between two adjacent sections of liner tubing 46 and 48. The position of the joint 44 relative to the liner hanger running tool 22, and so relative to the sensors 34, is known prior to deployment of the liner 16 into the wellbore 10. Determination that the stuck point 42 is below the sensors 34 (by the detection of strain in the tubular member 38) enables remedial action to be taken to release the joint 44. Typically, this will involve manipulating the string of drill pipe 24 to impart a force on the liner 16 so that the joint 44 is at a neutral load, or under a relatively small tension. Under normal circumstances, the liner 16 is suspended in the wellbore and so under tension. However, when the liner 16 becomes stuck at the point 42, the load of the portion of the liner 16 above the stuck point 42 is effectively borne by the collapsed zone 32 of the wellbore 10, the self-weight of the liner then placing that portion effectively under compression. Manipulation of the string to place the joint 44 at neutral load (or slight tension) involves imparting an axial load in the uphole direction 40 to balance off the self-weight of the portion of the liner 16 above the stuck point 42.

Torque is then applied to release the joint 44, through the drill pipe 24, the tubular member 38 and liner hanger running tool 22, via the dogs 26. Typically, the joint 44 will be a right hand threaded joint, so that a left hand torque must be applied to release it. Optionally, a low power string shot 50 comprising an explosive charge 52 may be run on wireline (not shown) down through the drill string 24, located adjacent the joint 44, and detonated. The charge 52 typically takes the form of a primer or 'det' cord, and is deployed to a position where it straddles the joint 44. Detonation of the charge 52 helps to shock the connection of the joint 44, assisting with back-off of the joint. Release of the joint 44 enables the portion of the liner 16 above the joint to be retrieved to surface. A dedicated 'fishing tool' (not shown) of a type known in the art can then be run-in to the wellbore 10, to import a large axial and/or rotary force on the portion of the liner 16 remaining in the wellbore 10, to retrieve it to surface.

Figure 2:
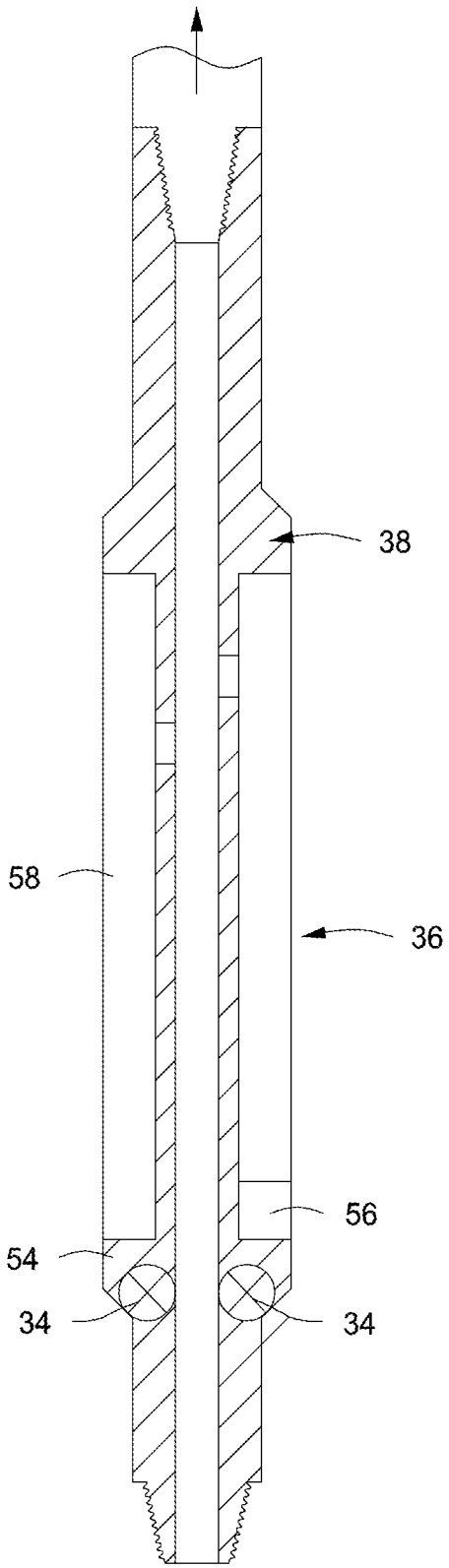
FIG. 2 is an enlarged view of a section of tubing carrying a data transmission device in the form of a fluid pressure pulse generating device, forming part of the tubing shown in FIG. 1, for transmitting data to surface.

The pulse generating device 36 is shown in more detail in the enlarged view of FIG. 2. The pulse generating device 36 is located in a space in a wall 54 of the tubular member 38, and is a device of the type disclosed in WO 2011/004180, the disclosure of which is incorporated herein by way of reference. A pulse generating device 36 of this type is a "through-bore" device, in which pulses can be generated without restricting a bore of tubing associated with the device. This allows the passage of other equipment, and in particular allows the passage of balls, darts and the like for the actuation of other tools/equipment, and indeed deployment of the string shot 50. Data is transmitted by means of a plurality of pulses generated by the device 36, which may be positive or negative pressure pulses. Data relating to the strain in the portion of the liner 16 above the stuck point 42 may thus be transmitted to surface using the pulse generating device 36, to facilitate a determination of the location of the stuck point 42. Operation of the pulse generating device 36, and its position in the tubular member 38, is otherwise as taught in WO 2011/004180, and so will not be described in further detail herein.

The measured strain data is communicated from the sensors 34 to a processor 56 associated with the pulse generating device 36. The sensors 34 are all coupled to the processor 56 via wiring extending along channels (not shown) in the tubular member 38, following the teachings of U.S. Pat. No. 6,547,016, the disclosure of which is incorporated herein by way of reference. The processor 56 controls the operation of the pulse generating device 36 to transmit fluid pressure pulses to surface relating to the measured strain data. Power for operation of the sensors 34, pulse generating device 36 and processor 56 is provided by a battery 58, also mounted in a space in the wall 54 of the tubular member 38.

Figure 3:
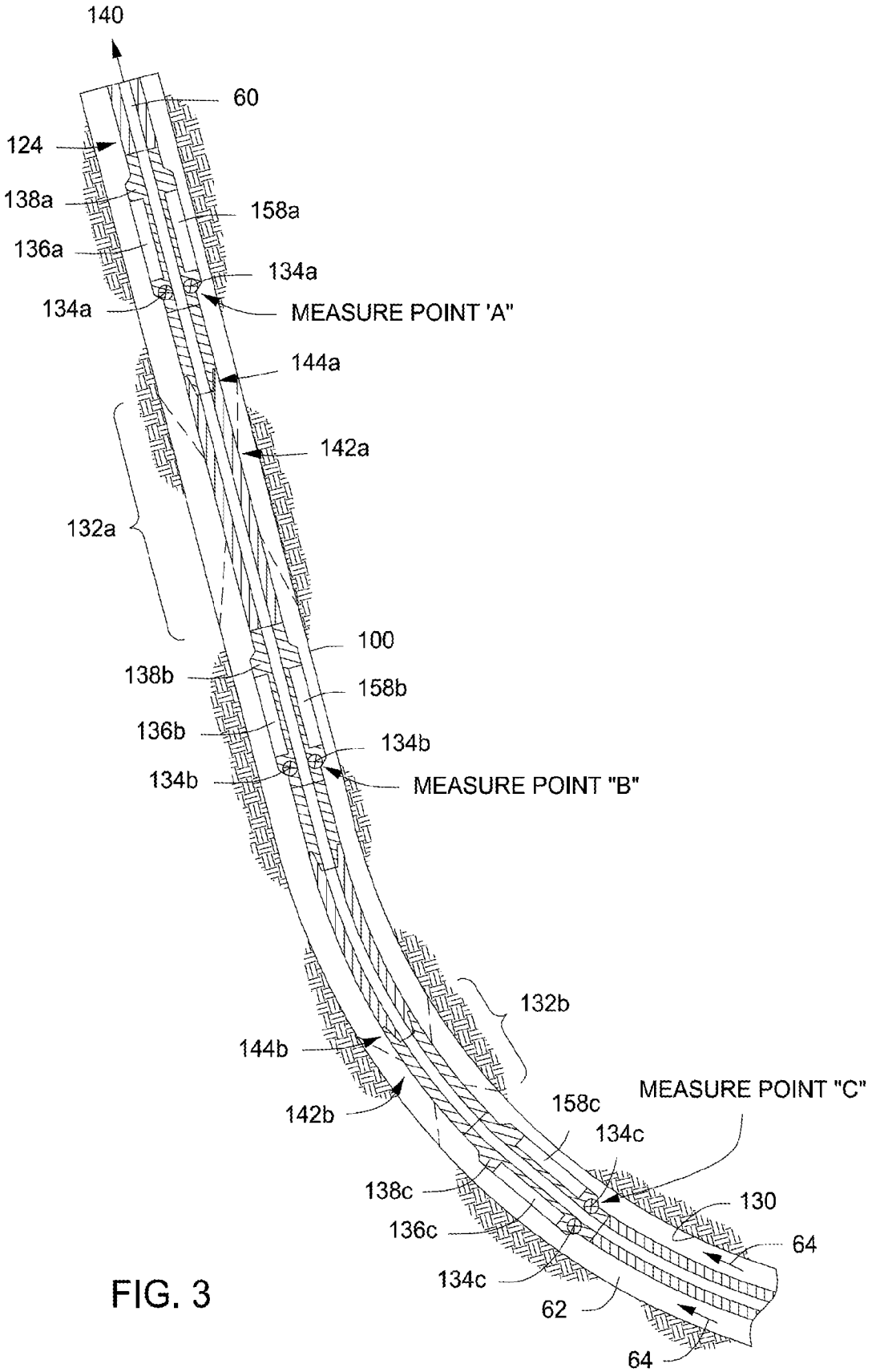
FIG. 3 is a schematic longitudinal sectional view of a string of tubing in the form of a drill pipe, illustrated during the drilling of a wellbore and showing the drill pipe after it has become stuck, the drawing illustrating steps in a method of determining the point at which the drill pipe has become stuck according to another embodiment of the invention.

Whilst the present invention provides the ability to determine the point at which a tubing has become stuck within a wellbore employing a strain sensor or sensors located at a single axial position along the length of the tubing, enhanced data could be obtained employing sensors positioned at a plurality of locations along the length of the tubing, and an associated plurality of data transmission devices. One such embodiment is shown in FIG. 3, which is a schematic longitudinal sectional view of a string of drill pipe 124 shown during the drilling of a wellbore 100. Like components with the embodiment of FIGS. 1 and 2 share the same reference numerals, incremented by 100.

The string of drill tubing 124 includes multiple sets of strain sensors 134*a*, 134*b* and 134*c* at spaced locations along the length of the string, defining corresponding measure points A, B and C. The sensors 134*a*, 134*b* and 134*c* are each mounted in respective tubular members 138*a*, 138*b* and 138*c* connected into the string of drill tubing 124, and which carry pulse generating devices 136*a*, 136*b* and 136*c* powered by batteries 158*a*, 158*b* and 158*c*, respectively.

The string of drill pipe 124 is shown in use, during drilling of the wellbore 100, which in this instance is a deviated wellbore. Typically there is a greater likelihood of a string of tubing becoming stuck during translation through a deviated portion of a wellbore, by contact with the wellbore wall. Positioning of the various sets of sensors 134*a, b* and *c* spaced along the length of the string of drill tubing 124 defines the different measure points A, B and C. This facilitates determination of the stuck point as will now be described. FIG. 3 shows two different examples of stuck points for the string of drill tubing 124, indicated by reference numerals 142*a* and 142*b* respectively. This has resulted from two different zones 132*a*, 132*b* of the wellbore 100 collapsing in on the string of drill tubing 124.

In the example of collapse in the zone 132*a*, in which the tubing has become stuck at point 142*a*, an axial pull force exerted on the string of drill tubing 124 in the direction 140 will stimulate a strain in the portion of the string of drill tubing 124 above the stuck point 142*a*. The portion of the string of drill tubing 124 below the stuck point 142*a* will effectively be in compression. The strain in the portion of drill tubing 124 above the stuck point 142*a* is detected by the strain sensors 134*a*, and this data sent to surface by means of fluid pressure pulses generated by the pulse generating device 136*a*.

Below the stuck point, the sensors 134*b* and 134*c* will not experience any tensile strain loading (or at least any additional tensile strain loading resulting from application of the pull force). The pulse generating devices 136*a*, 136*b* and 136*c* are operated sequentially to transmit strain data from the corresponding sensors 134*a*, 134*b* and 136*c* to surface. The strain data is, in this example, indicative that a collapse has occurred at a location between the sensors 134*a* and 134*b*, which enables remedial action to be taken to release a joint 144*a* in the string of drill tubing 124, following the technique described above.

In the illustrated example, a wellbore collapse in the zone 132*a* is shown. It will be understood that this may prevent operation of the pulse generating devices 136*b* and 136*c*, and so may prevent the transmission of strain data from the sensors 134*b* and 134*c* to surface. This is because operation of the pulse generating devices 136*a, b* and *c* requires flow of fluid down through a bore 60 of the string of drill tubing 124, exiting the string at a drill bit (not shown) on a downhole end of the string and passing along an annular region 62 defined between the string of tubing 124 and the wellbore wall 130, as indicated by the arrows 64. Collapse of the wellbore wall 130 in the zone 132*a* prevents the flow of fluid along the annular region 62 and so the transmission of data to surface. This in itself is indicative that the collapse has occurred at a location between the sensors 134*a* and 134*b*. However, in alternative sticking examples, in particular where differential sticking occurs, fluid flow along the annular region 64 may be possible. In this scenario, the strain data from the sensors 134*b*, 134*c* is the primary method employed to determine the stuck point.

In the alternative example of collapse of the wellbore wall in the zone 132*b*, the strain data transmitted from the sensors 134*a* and 134*b* will both reflect a strain in the portion of the string of drill tubing 124 above the stuck point 142*b*. The strain measured by the sensors 134*a* will be greater than that measured by the sensors 134*b*, indicating that the stuck point is closer to the sensors 134*b*. Once again, the strain data from the sensors 134*c* will either be prevented from being communicated to surface by the wellbore collapse in the zone 132*b*, or will be indicative that the portion of the string of drill tubing 124 below the stuck point 142*b* is not undergoing tensile strain (or additional strain from the pull force). This enables a determination to be made that the stuck point 142*b* is between the sensors 134*b* and 134*c*, so that remedial action can be taken to release a joint 144*b* in the string of drill tubing 124, following the technique described above.

Whilst FIG. 3 shows the example of tubing in the form of a string of drill tubing 124, it will be understood that the principles may be applied to other types of tubing, in particular wellbore lining tubing such as the liner 16 shown and described in FIG. 1. Thus the liner 16 may itself carry the sensors 34 and fluid pressure pulse generating device 36, and optionally a plurality of sets of sensors and associated pulse generating devices. Operation of the pulse generating device or devices 36 in the liner 16 may be possible up until such time as the liner is cemented in the portion 18 of the wellbore 10.

Figure 4:
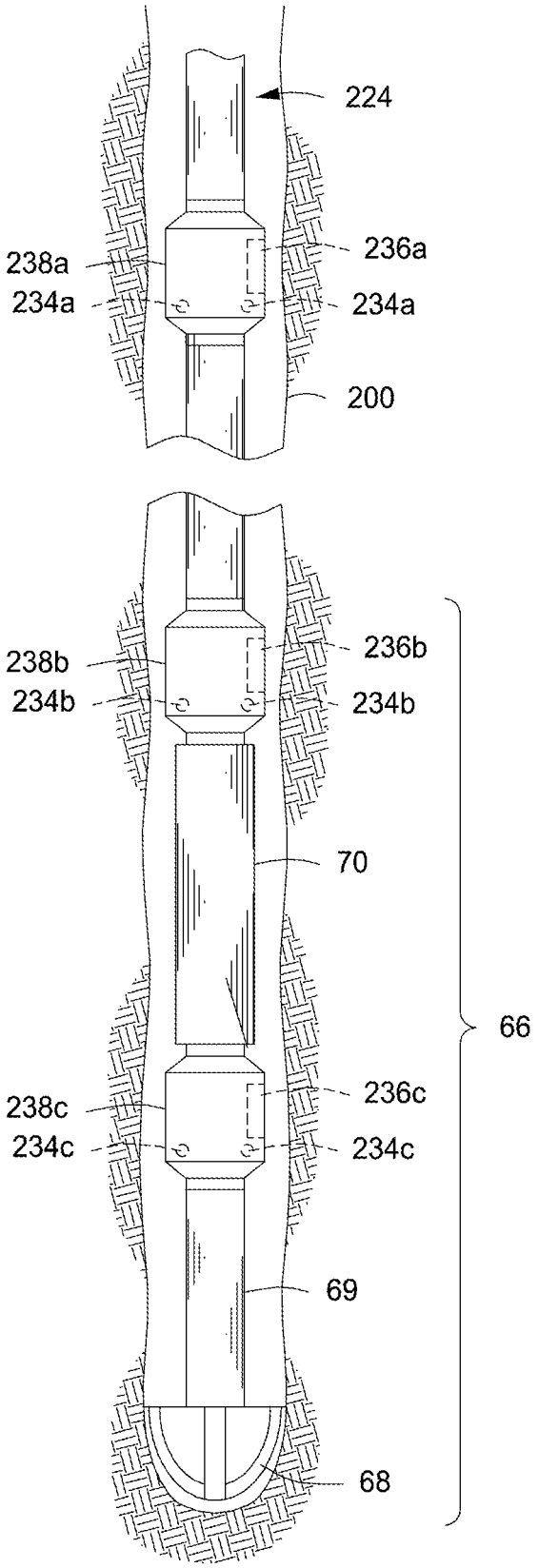
FIG. 4 is a schematic longitudinal sectional view of a variation on the embodiment shown and described in FIG. 3.

Turning now to FIG. 4, there is shown a variation on the embodiment of the tubing 124 shown in FIG. 3, where a string of drill tubing 224 is shown located in a wellbore 200. Like components share the same reference numerals as in FIG. 3, incremented by 100. The string of drill tubing 224 includes a drilling assembly, which is typically known in the industry as a borehole assembly (or BHA) 66. The BHA 66 includes a drill bit 68, an optional fluid motor 69 for driving the bit (although the entire string may be rotated from surface), one or more lengths of relatively thick walled tubing known as drill collar 70, and two sets of sensors 234*b*, 234*c* and associated pulse generating devices 236*b* and 236*c*.

Typically, in a drilling situation, sticking of the string of drill pipe 224 will occur in the region of the BHA 66. It is therefore advantageous to provide at least two of the sets of sensors 234*b*, 234*c* and associated fluid pressure pulse generating devices 236*b* and 236*c* in the BHA. This is achieved by providing tubular members 238*b* and 238*c*, carrying the respective sensors and fluid pressure pulse generating devices, as part of the BHA 66. A further set of sensors 234*a* and fluid pressure pulse generating device 236*a* are mounted in a tubular member 238*a* provided in the string of drill tubing 224 further uphole, to enable determination of a stuck point which occurs uphole of the BHA 66.

Figure 5:
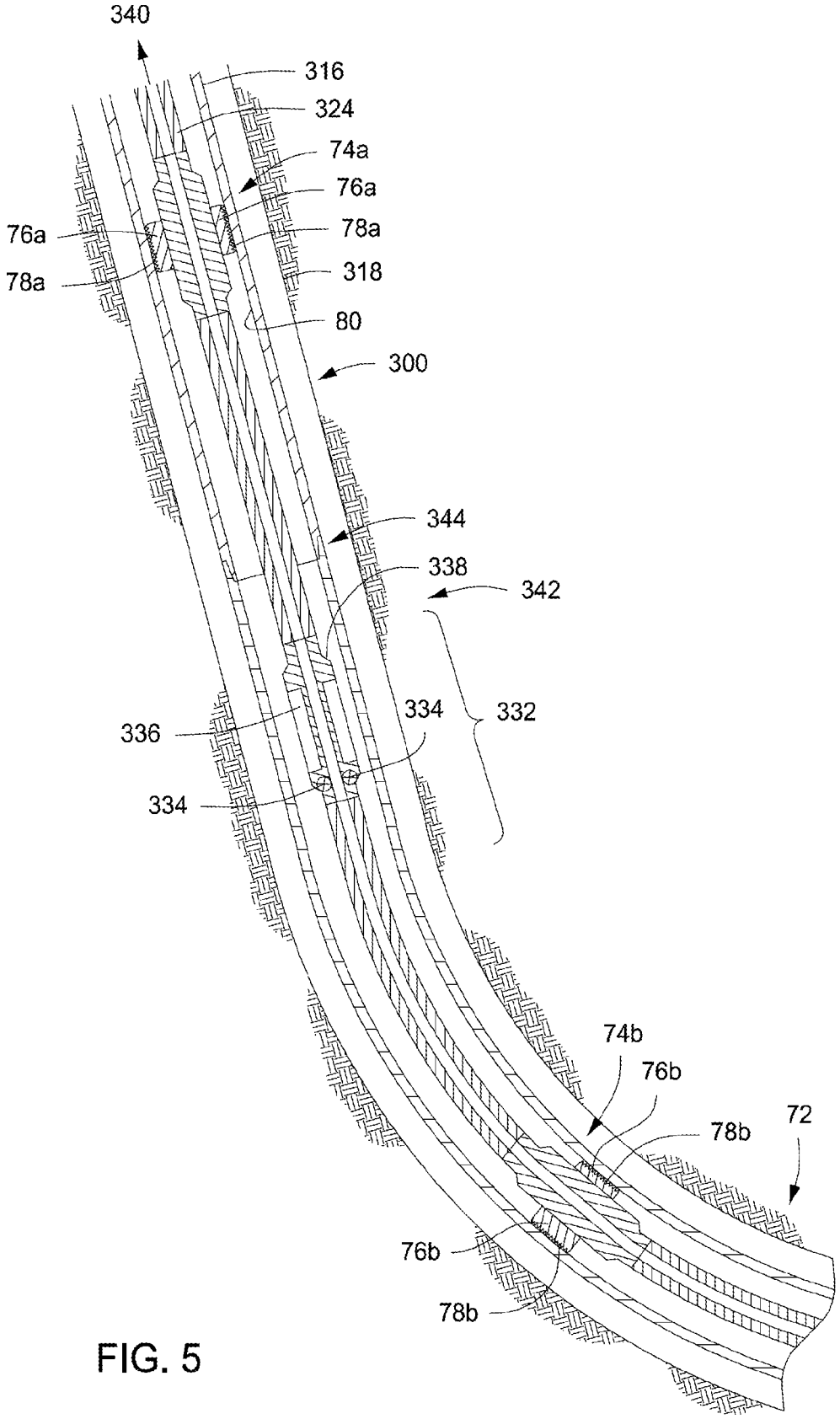
FIG. 5 is a view similar to FIG. 1 of a wellbore during a procedure to position a wellbore-lining tubing in the form of a liner, the drawing showing the liner after it has become stuck, and illustrating steps in a method of determining the point at which the liner has become stuck according to another embodiment of the invention.

Turning now to FIG. 5, there is shown a further variation on the method of the present invention, in which a string of tubing in the form of a liner 316 is shown during running into an unlined or open hole portion 318 of a wellbore 300. Like components with the embodiment of FIG. 1 share the same reference numerals incremented by 300.

In this instance, the liner 316 has become stuck in the wellbore 300 during transition into a deviated portion 72 of the wellbore 300. The liner 316 has become stuck due to differential sticking in a zone 332. The drawing also shows a string of drill tubing 324 which is employed to run the liner 316 into the wellbore 300, following the technique discussed above in relation to FIG. 1. Accordingly, the string of drill tubing 324 carries a liner hanger running tool (not shown) at a downhole end of the string.

When the liner 316 becomes stuck and so cannot be translated and/or rotated within the wellbore 300, the liner hanger running tool is released from the liner 316, so that the string of drill tubing 324 can be translated into the liner 316. It will be noted that, in this example, the relative dimensions of the wellbore 300, liner 316 and components of the string of drill tubing 324 are such that the drill tubing can be run into the liner 316. In particular, suitable clearance is required between an internal surface of the liner 316 and an external surface of the components of the string of drill tubing 324.

Typically, the string of drill tubing 324 will include a plurality of sets of strain sensors and corresponding fluid pressure pulse generating devices, but it is conceivable that determination of the stuck point can be achieved with a single set of sensors and corresponding pulse generating device. FIG. 5 shows one such set of sensors 334 and a pulse generating device 336, located in a tubular member 338 which is provided as part of the string of drill tubing 324.

The string of drill tubing 324 also carries two selectively activatable anchor devices 74*a* and 74*b*, which can be operated to engage the liner 316. The anchor devices 74*a*, 74*b* include anchoring elements 76*a*, 76*b* having serrated surfaces 78*a*, 78*b*, which bite into and engage the inner wall 80 of the liner 316. This securely re-anchors the string of drill tubing 324 to the liner 316, so that an axial pull force can be exerted on the liner 316, using the string of drill tubing 324, in the direction of the arrow 340.

The sensors 334 and fluid pressure pulse generating device 336 are positioned in the string of drill tubing 324 between the first and second anchoring devices 74*a* and 74*b*. In this way, any strain in the string of drill tubing 324 which occurs between the anchoring devices 74*a* and 74*b* can be detected and measured by the sensors 334, and that data sent to surface by the fluid pressure pulse generating device 336.

In the illustrated example, the stuck point 342 of the liner 316 is in the region of the differential sticking zone 332. Consequently, imparting an axial pull force on the liner 316 will result in a strain in the portion of the liner 316 above the stuck point 342, whereas no detectable change in strain will be detected in the portion of the liner 316 below the stuck point 342. As shown, the anchoring devices 74*a* and 74*b* effectively axially straddle the stuck point 342. The result of this is that, when the axial pull force is exerted on the liner 316, the anchor member 74*a* will act to extend the portion of the liner 316 above the stuck point 342, with a resultant strain occurring in that portion of the liner. This strain will be measured by the sensors 334 and can be transmitted to surface. A determination can then be made that the stuck point 342 is at a location which is between the anchoring devices 74*a* and 74*b*. Remedial action can then be taken to release a joint 344 of the liner 316 following the technique described above.

In the event that no strain is detected by the sensors 334, this is indicative that the stuck point 342 is either downhole of the lower anchoring device 74*b*, or uphole of the upper anchoring device 74*a*. The anchoring devices 74*a, b* would thus be released from their engagement with the liner 316, and translated to a different position in the liner, before being reactivated and the procedure repeated until the stuck point 342 is located.

Typically, an initial measurement will be taken at a position which is expected to be above the stuck point 342, so that the drill string 324 can be progressively lowered until the stuck point is located. This procedure for locating the stuck point 342 may be facilitated by the provision of multiple sets of sensors 334 and associated fluid pressure pulse generating devices 336, as mentioned above. Furthermore and in the event of wellbore collapse, the transmission of data to surface using the fluid pressure pulse generating devices 336 may be prevented, providing a further indication of the location of the stuck point 342, as explained above.

A further variation of the invention may be based on the embodiments of FIG. 1, in which the string of drill tubing 24 includes an extension portion or tubing 'tail' (not shown) which extends from the liner hanger running tool and down into the liner 16. This tail may carry or define the tubular member 38, which may be shaped to fit within the liner 16, and so may carry the sensors 34 and fluid pressure pulse generating device 36. Anchoring devices, similar to the devices 74*a* and 74*b* shown in FIG. 5, may be provided in the tubing extension portion so that the string of drill tubing can be anchored to the liner 16 to stress the liner and so determine the location of a stuck point, following the teachings of FIG. 5 discussed above. The sensors 34 and pulse generating device 36 in the extension portion may be provided in addition to those shown in FIG. 1, and/or additional sensors and associated pulse generating devices may be provided in the extension portion, following the teachings of FIG. 3.

Figure 6:
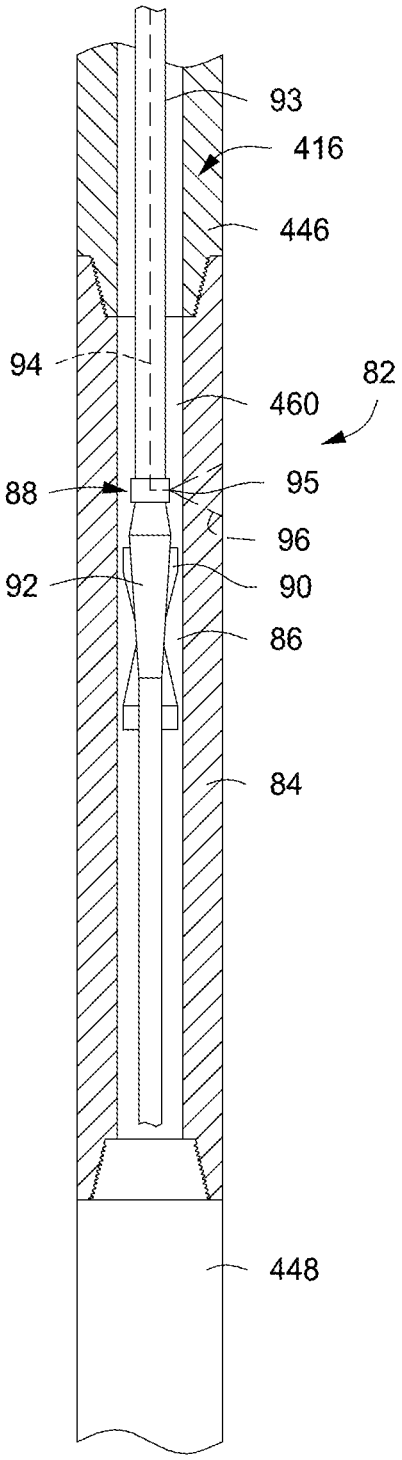
FIG. 6 is a longitudinal part sectional view of a tubing recovery system which may be provided as part of any of the tubing shown in FIGS. 1 to 5, to facilitate recovery of the part of the tubing located above a stuck point.

Turning now to FIG. 6, there is shown a longitudinal part sectional view of a tubing recovery system which may be provided as part of any of the tubing strings disclosed herein, to facilitate recovery of the part of the tubing string located above a stuck point. The tubing recovery system is indicated generally by reference numeral 82, and is of the type which is commercially available from Warrior Energy Services, a Superior Energy Services, Inc. company. FIG. 6 shows a tubing string in the form of a liner 416. Like components with FIG. 1 share the same reference numerals, incremented by 400. It will be understood though that the system 82 has a use in other types of tubing.

Sections 446 and 448 of liner tubing are shown, which are coupled together by means of a sacrificial tubing section 84, which may be of material which is of a lower hardness than that of the tubing sections 446 and 448. A restriction 86 is provided in a bore 460 of the liner 416. In the event that the liner 416 becomes stuck in a wellbore, a release device, indicated generally by reference numeral 88, is run into the liner 416 and landed on the restriction 86. The release device includes a seat element 90 defining a tapered seat surface 92 which is shaped to seat on the restriction 86, so as to land the release device 88 on the restriction. The release device 88 is run on tubing 93 which defines a fluid pathway 94, so that a jet 95 of fluid can be directed onto the sacrificial tubing section 84. This cuts the sacrificial section 84 in an area 96, weakening the section sufficiently so that an axial pull force and/or rotation of the liner 416 will sever the sacrificial section. This facilitates recovery of the portion of the liner 416 above the cut 96 to surface. The remaining portion of the liner 416 can then be fished out of the hole using a fishing device, which may be shaped to cooperate with the restriction 86.

Optionally, a plurality of such tubing recovery systems 82, each having a corresponding restriction 86, may be provided spaced along the length of the liner 461. The restrictions 86 of the recovery systems 82 may define progressively increasing dimension restrictions, taken in a downhole direction. A range of release devices of different dimensions, each dimensioned to fit a selected one of the restrictions 86, may be selected and deployed into the liner 416. The release device 88 which is selected passes down the liner 416 until it encounters the restriction 86 which it is dimensioned to fit, where it lands out and enables subsequent separation of the liner 416 at that point, by severing the respective sacrificial tubing section 84. This may facilitate severing of the liner 416 at a desired location, appropriate to the determined stuck point of the tubing.

Figure 7:
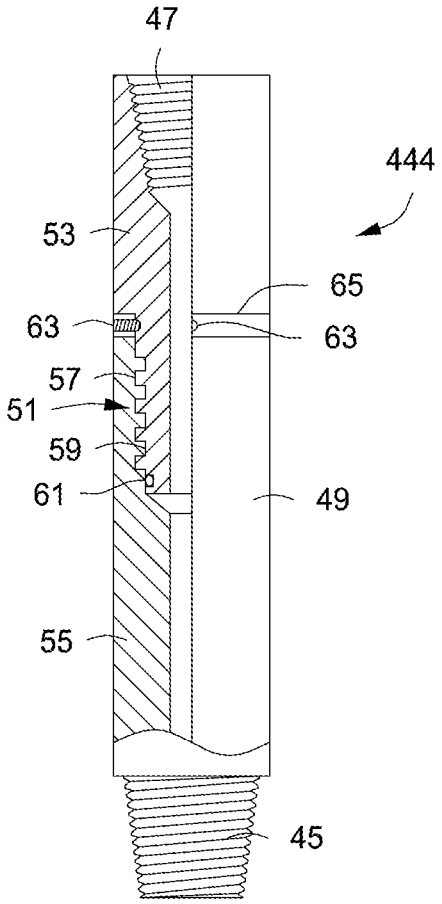
FIG. 7 is a longitudinal part sectional view of an exemplary releasable joint which may be provided as part of any of the tubing shown in FIGS. 1 to 5.

Turning now to FIG. 7, an exemplary releasable joint assembly 444 is shown and will now be described. The releasable joint assembly 444 has a utility in any of the different types of tubing string disclosed herein, but will be described in relation to a drill string, such as the drill string 124 of FIG. 3, where it is provided in place of one or more standard joint, such as the joints 144*a, b*. The releasable joint assembly 444 forms a release assembly having a body 49 with standard pin and box connections 45 and 47, typically having right handed threads. The pin 45 and box 47 are provided at opposite ends of the body 49, and serve for coupling the body to adjacent sections of drill tubing forming the string 124. A releasable joint 51 is disposed between the first and second ends of the body 49, and arranged so that it can be selectively released on application of a (left hand) release torque. The releasable joint assembly 51 comprises relatively large, shallow pitch angle threads and is arranged to release on application of a sufficiently large release torque. The body 49 includes an upper part 53 and a lower part 55, the upper part including a thread 57 of the joint assembly 51, which engages with a corresponding thread 59 on the lower part 55. The upper and lower parts 53 and 55 are sealed relative to one another by means of an O-ring 61 or similar suitable seal, and are initially held against relative rotation by means of set screws 63. The set screws 63 prevent over-torquing of the releasable joint during make-up of the drill string 124, and indeed during normal operation and so rotation of the drill string in which the joint is deployed. The set screws extend through a friction ring 65 provided between the upper and lower parts 53 and 55, to facilitate release when a sufficient (left hand) release or break out torque is applied, shearing the set screws 63. The friction ring 65 facilitates make-up and break-out of the joint 51.

Figure 8:
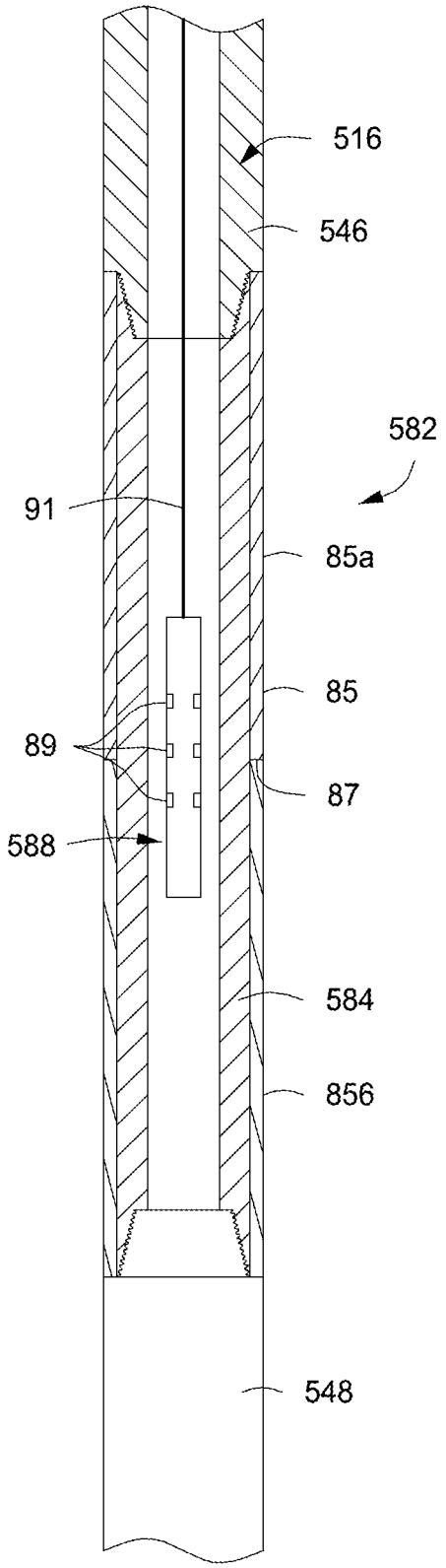
FIG. 8 is a longitudinal part sectional view of an alternative embodiment of a tubing recovery system, which may be provided as part of any of the tubing strings shown in FIGS. 1 to 5, to facilitate recovery of the part of the tubing string located above a stuck point.

FIG. 8 is a longitudinal part sectional view of an alternative embodiment of a tubing recovery system 582, which may be provided as part of any of the tubing strings disclosed herein, to facilitate recovery of the part of the tubing string located above a stuck point. A system of this type is again available from Warrior Energy Services. Like components of the recovery system 582 with the system 82 of FIG. 6 share the same reference numerals, incremented by 500.

In this embodiment, the tubing recovery system 582 comprises a release device 588 in the form of a body carrying explosive charges 89, which can be activated to sever a tubing string such as a liner 516. The device 588 is run-in on wireline 91, which enables a firing signal to be sent to detonate the charges 89. The liner 516 carries a sacrificial section in the form of a sacrificial inner sleeve 584, detonation of the charges 89 acting to sever the sacrificial sleeve (optionally with an axial pull to assist in severing). The liner 516 also includes an outer sleeve 85 which, together with the inner sleeve 584, effectively forms a section or part of the liner 516, coupled between sections 546 and 548 of the liner tubing. The outer sleeve 85 serves for transmitting torque, and comprises a joint 87 which can be axially separated on severing of the sacrificial inner sleeve 584. Typically, the joint 87 comprises castellations formed on upper and lower parts 85*a* and 85*b* of the outer sleeve, which mesh to permit transmission of torque through the sleeve 85, but which can axially separate when the inner sleeve 584 has been severed. The inner sleeve 584 will typically be of a material which is of a lower hardness than a material of the outer sleeve 85, so that the inner sleeve is severed when the charges 89 are detonated and with minimal or restricted damage to the outer sleeve. The inner sleeve 584 is intended to support or transmit axial loading (weight), whilst the outer sleeve 85 is intended to support or transmit rotational loads (torque), as discussed above.

In use, the device 588 is deployed into the liner 516, and located at a position where the liner 516 is to be severed (i.e., above a stuck point). The device 588 is then operated to sever the inner sleeve 584, so that an axial pull force can be imparted to the outer sleeve 85, to separate the joint 87. A part of the liner 516 located uphole of the position where the liner has been severed (at joint 87) can then be separated from the part of the liner downhole of said position, and recovered to surface. The portion of the inner sleeve 584 remaining in the wellbore forms a fishing neck which a fishing tool (not shown) can latch into, to retrieve the remainder of the liner 516.

Various modifications may be made to the foregoing without departing from the spirit or scope of the present invention.

For example, a number of different primary operations, employing a tubing string for performing the operation, are shown and described herein. It will be understood that tubing strings appropriate for performing a wide range of different primary operations may be employed, and that the method of the present invention may be used to facilitate the determination of the stuck point of any such tubing string. Further tubing strings and so primary operations may include those associated with a workover or intervention operations, which may be performed subsequent to lining and cementing of a wellbore.

The primary operation may be a wellbore-lining operation, involving positioning the tubing string in the wellbore where it lines at least part of a wall of the drilled wellbore wall. The tubing string may be a wellbore-lining tubing, which may be casing, liner, sandscreen or the like.

The primary operation may be a workover or intervention operation, which may be performed subsequent to lining and cementing of the wellbore. The tubing string may be a workover or intervention tubing string, used to deploy a workover or intervention tool into the wellbore.

The tubing string may be made up from a series of lengths or sections of tubing coupled together end-to-end. However, the invention has a utility with continuous lengths of tubing, such as coiled tubing.

Whilst a preferred form of data transmission in the illustrated embodiments is by means of fluid pressure pulses, alternative data transmission methods may be employed. One particular alternative is to transmit data to surface acoustically, and the data transmission device may then be or may take the form of an acoustic data transmission device. The device may comprise a primary transmitter associated with the at least one sensor, for transmitting the data. The method may comprise positioning at least one repeater uphole of the primary transmitter, and arranging the repeater to receive a signal transmitted by the primary transmitter and to repeat the signal to transmit the data to surface.

Embodiments disclosed herein include:

A. A method that includes introducing a string of tubing into a wellbore to perform a primary operation, the string of tubing including at least one sensor for measuring strain and at least one device operatively associated with the at least one sensor, translating the string of tubing relative to the wellbore, imparting a load on the string of tubing when the tubing becomes stuck in the wellbore at a stuck point and thereby generating strain in the string of tubing above the stuck point, measuring the strain with the at least one sensor, transmitting data indicative of the strain to a surface location with the at least one device, and determining a position of the at least one sensor in the wellbore, as based on the strain, relative to the stuck point.

B. Another method may include introducing a string of tubing into a wellbore, the string of tubing including a primary tubing string and a secondary tubing string operably coupled to the primary tubing string, the secondary tubing string including at least one sensor for measuring strain and at least one device operatively coupled to the at least one sensor, translating the primary tubing string within the wellbore with the secondary tubing string, releasing the secondary tubing string from the primary tubing string when the primary tubing string becomes stuck in the wellbore, translating the secondary tubing string relative to the primary tubing string until at least partially disposed within the primary tubing string, engaging first and second axially spaced anchors of the secondary tubing string against an interior of the primary tubing string, wherein the at least one sensor is arranged axially between the first and second anchors, imparting a load on the secondary tubing string and thereby generating a strain in the secondary tubing string detectable by the at least one sensor, and determining a stuck point of the primary tubing string within the wellbore based on the strain detected by the at least one sensor.

C. A wellbore assembly includes a string of tubing extendable within a wellbore for performing a primary operation, at least one sensor for measuring strain in the string of tubing, and at least one device operatively coupled to the at least one sensor for transmitting data to a surface location, wherein, when the string of tubing becomes stuck within the wellbore, the at least one device measures strain in the string of tubing above a point in the wellbore where the tubing has become stuck, and wherein the at least one device transmits data indicative of the strain to the surface location such that a position of the at least one sensor in the wellbore relative to the point where the tubing has become stuck is determined as based on the strain.

Each of embodiments A, B, and C may have one or more of the following additional elements in any combination. Element 1: wherein imparting the load on the string of tubing comprises imparting at least one of an axial load and a torsional load. Element 2: further comprising introducing a tubing recovery system into the wellbore, operating the tubing recovery system above the stuck point, and recovering at least an upper portion of the string of tubing above the stuck point. Element 3: wherein the tubing recovery system includes a release device, the method further comprising landing the release device on a restriction provided within the string of tubing above the stuck point, activating a jet arranged on the release device to direct fluid toward an inner surface of the string of tubing and thereby weaken the inner surface, and separating the upper portion of the string of tubing from a lower portion of the string of tubing below the stuck point. Element 4: wherein separating the upper portion of the string of tubing comprises at least one of imparting an axial load on the string of tubing and imparting a torsional load on the string of tubing. Element 5: wherein the string of tubing includes a sacrificial section and the method further comprises directing the jet of fluid toward the sacrificial section to sever the string of tubing. Element 6: wherein the tubing recovery system includes a release device including one or more explosives, the method comprising detonating the one or more explosives and thereby severing a sacrificial inner sleeve disposed within the string of tubing, imparting an axial or torsional load on the string of tubing and thereby severing an outer sleeve included in the string of tubing, and separating the upper portion of the string of tubing from a lower portion of the string of tubing below the stuck point. Element 7: wherein a releasable joint assembly is disposed within the string of tubing and includes a body having upper and lower parts coupled at a releasable joint, the method further comprising applying a torque on the releasable joint via the string of tubing and thereby releasing a friction ring provided between the upper and lower parts, wherein the upper part is coupled to an upper portion of the string of tubing and the lower part is coupled to a lower portion of the string of tubing, and separating the upper portion of the string of tubing from the lower portion of the string of tubing. Element 8: wherein the at least one device is an acoustic transmitter and transmitting data to the surface location with the at least one device comprises transmitting the data acoustically to the surface location. Element 9: wherein the at least one device is a fluid pressure pulse generating device and transmitting data to the surface location with the at least one device comprises generating one or more fluid pressure pulses with the fluid pressure pulse generating device.

Element 10: further comprising generating the strain in the secondary tubing string via relative axial movement between the first and second anchors. Element 11: wherein imparting the load on the secondary tubing comprises imparting at least one of an axial and a torsional load on the secondary tubing. Element 12: wherein determining the stuck point of the primary tubing within the wellbore further comprises transmitting data indicative of the strain to a surface location with the at least one device. Element 13: wherein the at least one device is an acoustic transmitter and transmitting data indicative of the strain to the surface location with the at least one device comprises transmitting the data acoustically to the surface location. Element 14: wherein the at least one device is a fluid pressure pulse generating device and transmitting data indicative of the strain to the surface location with the at least one device comprises generating one or more fluid pressure pulses with the fluid pressure pulse generating device. Element 15: further comprising introducing a tubing recovery system into the wellbore, operating the tubing recovery system above the stuck point, severing the primary tubing string into upper and lower portions with the tubing recovery system, and retrieving the upper portion of the primary tubing string to a surface location.

Element 16: wherein the strain results from a load applied on the string of tubing from the surface location, the load comprising at least one of an axial load and a torsional load. Element 17: wherein the string of tubing is selected from the group consisting of drill string, liner, casing, sandscreen, coiled tubing, and any combination thereof. Element 18: wherein the string of tubing comprises a primary tubing string and a secondary tubing string operably coupled to the primary tubing string, wherein the at least one sensor and the at least one device are arranged on the secondary tubing string. Element 19: wherein the secondary tubing string further includes first and second anchors axially spaced from each other, and wherein the at least one sensor is arranged between the first and second anchors. Element 20: further comprising a tubing recovery system extendable within the wellbore and including a release device extendable within the string of tubing and having a tapered seat surface engageable with a restriction defined within the string of tubing, and a jet provided on the release device for ejecting a fluid toward an inner wall of the string of tubing and thereby weakening the string of tubing. Element 21: further comprising a releasable joint assembly that includes a body arranged within the string of tubing and having an upper part coupled to an upper portion of the string of tubing and a lower part coupled to a lower portion of the string of tubing, a releasable joint coupling the upper and lower parts, and a friction ring arranged on the body at the releasable joint to prevent relative rotation of the upper and lower parts, wherein the friction ring is released upon assuming a torque as applied on the string of tubing and thereby separating the upper and lower portions of the string of tubing. Element 22: further comprising a tubing recovery system extendable within the wellbore and including a release device extendable within the string of tubing and having a body with one or more explosives disposed thereon, and a sacrificial inner sleeve arranged within the string of tubing, an outer sleeve arranged within the string of tubing and having an upper part coupled to an upper portion of the string of tubing and a lower part coupled to a lower portion of the string of tubing, and a castellated joint coupling the upper and lower parts of the outer sleeve, wherein detonation of the one or more explosives severs the sacrificial inner sleeve and an axial load applied on the string of tubing separates the upper and lower portions at the castellated joint. Element 23: wherein the at least one device is at least one of a fluid pressure pulse generating device and an acoustic transmitter.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method, comprising:

introducing a string of tubing into a wellbore to perform a primary operation, the string of tubing including at least one sensor for measuring strain and at least one device operatively associated with the at least one sensor;

translating the string of tubing relative to the wellbore;

imparting a load on the string of tubing when the tubing becomes stuck in the wellbore at a stuck point and thereby generating strain in the string of tubing above the stuck point;

measuring the strain with the at least one sensor;

transmitting data indicative of the strain to a surface location with the at least one device;

determining a position of the at least one sensor in the wellbore, as based on the strain, relative to the stuck point; and introducing a tubing recovery system into the wellbore, the tubing recovery system including a release device having a seat surface engageable with a restriction provided within the string of tubing.

2. The method of claim 1, wherein imparting the load on the string of tubing comprises imparting at least one of an axial load and a torsional load.

3. The method of claim 1, further comprising:

operating the tubing recovery system above the stuck point; and recovering at least an upper portion of the string of tubing above the stuck point.

4. The method of claim 3, further comprising:

landing the release device on the restriction provided within the string of tubing above the stuck point;

activating a jet arranged on the release device to direct fluid toward an inner surface of the string of tubing and thereby weaken the inner surface; and separating the upper portion of the string of tubing from a lower portion of the string of tubing below the stuck point.

5. The method of claim 4, wherein separating the upper portion of the string of tubing comprises at least one of imparting an axial load on the string of tubing and imparting a torsional load on the string of tubing.

6. The method of claim 4, wherein the string of tubing includes a sacrificial section and the method further comprises directing the jet of fluid toward the sacrificial section to sever the string of tubing.

7. The method of claim 3, wherein the tubing recovery system includes a release device including one or more explosives, the method comprising:

detonating the one or more explosives and thereby severing a sacrificial inner sleeve disposed within the string of tubing;

imparting an axial or torsional load on the string of tubing and thereby severing an outer sleeve included in the string of tubing; and separating the upper portion of the string of tubing from a lower portion of the string of tubing below the stuck point.

8. The method of claim 1, wherein a releasable joint assembly is disposed within the string of tubing and includes a body having upper and lower parts coupled at a releasable joint, the method further comprising:

applying a torque on the releasable joint via the string of tubing and thereby releasing a friction ring provided between the upper and lower parts, wherein the upper part is coupled to an upper portion of the string of tubing and the lower part is coupled to a lower portion of the string of tubing; and separating the upper portion of the string of tubing from the lower portion of the string of tubing.

9. The method of claim 1, wherein the at least one device is an acoustic transmitter and transmitting data to the surface location with the at least one device comprises transmitting the data acoustically to the surface location.

10. The method of claim 1, wherein the at least one device is a fluid pressure pulse generating device and transmitting data to the surface location with the at least one device comprises generating one or more fluid pressure pulses with the fluid pressure pulse generating device.

11. A method, comprising:

introducing a string of tubing into a wellbore, the string of tubing including a primary tubing string and a secondary tubing string operably coupled to the primary tubing string, the secondary tubing string including at least one sensor for measuring strain and at least one device operatively coupled to the at least one sensor;

translating the primary tubing string within the wellbore with the secondary tubing string;

releasing the secondary tubing string from the primary tubing string when the primary tubing string becomes stuck in the wellbore;

translating the secondary tubing string relative to the primary tubing string until at least partially disposed within the primary tubing string;

engaging first and second axially spaced anchors of the secondary tubing string against an interior of the primary tubing string, wherein the at least one sensor is arranged axially between the first and second anchors;

imparting a load on the secondary tubing string and thereby generating a strain in the secondary tubing string detectable by the at least one sensor; and determining a stuck point of the primary tubing string within the wellbore based on the strain detected by the at least one sensor.

12. The method of claim 11, further comprising generating the strain in the secondary tubing string via relative axial movement between the first and second anchors.

13. The method of claim 11, wherein imparting the load on the secondary tubing comprises imparting at least one of an axial and a torsional load on the secondary tubing.

14. The method of claim 11, wherein determining the stuck point of the primary tubing within the wellbore further comprises transmitting data indicative of the strain to a surface location with the at least one device.

15. The method of claim 14, wherein the at least one device is an acoustic transmitter and transmitting data indicative of the strain to the surface location with the at least one device comprises transmitting the data acoustically to the surface location.

16. The method of claim 14, wherein the at least one device is a fluid pressure pulse generating device and transmitting data indicative of the strain to the surface location with the at least one device comprises generating one or more fluid pressure pulses with the fluid pressure pulse generating device.

17. The method of claim 11, further comprising:

introducing a tubing recovery system into the wellbore;

operating the tubing recovery system above the stuck point;

severing the primary tubing string into upper and lower portions with the tubing recovery system; and retrieving the upper portion of the primary tubing string to a surface location.

18. A wellbore system, comprising:

a string of tubing extendable within a wellbore for performing a primary operation;

at least one sensor for measuring strain in the string of tubing; and at least one device operatively coupled to the at least one sensor for transmitting data to a surface location, wherein:

when the string of tubing becomes stuck within the wellbore, the at least one device measures strain in the string of tubing above a point in the wellbore where the tubing has become stuck; and the at least one device transmits data indicative of the strain to the surface location such that a position of the at least one sensor in the wellbore relative to the point where the tubing has become stuck is determined as based on the strain; and a tubing recovery system including a release device having a seat surface engageable with a restriction provided within the string of tubing.

19. The wellbore system of claim 18, wherein the strain results from a load applied on the string of tubing from the surface location, the load comprising at least one of an axial load and a torsional load.

20. The wellbore system of claim 18, wherein the string of tubing is selected from the group consisting of drill string, liner, casing, sandscreen, coiled tubing, and any combination thereof.

21. The wellbore system of claim 18, wherein the string of tubing comprises a primary tubing string and a secondary tubing string operably coupled to the primary tubing string, wherein the at least one sensor and the at least one device are arranged on the secondary tubing string.

22. The wellbore system of claim 21, wherein the secondary tubing string further includes first and second anchors axially spaced from each other, and wherein the at least one sensor is arranged between the first and second anchors.

23. The wellbore system of claim 18, wherein:

the release device is extendable within the string of tubing and has a tapered seat surface engageable with a restriction defined within the string of tubing; and the tubing recovery system further comprises a jet provided on the release device for ejecting a fluid toward an inner wall of the string of tubing and thereby weakening the string of tubing.

24. The wellbore system of claim 18, further comprising a releasable joint assembly that includes:

a body arranged within the string of tubing and having an upper part coupled to an upper portion of the string of tubing and a lower part coupled to a lower portion of the string of tubing;

a releasable joint coupling the upper and lower parts; and a friction ring arranged on the body at the releasable joint to prevent relative rotation of the upper and lower parts, wherein the friction ring is released upon assuming a torque as applied on the string of tubing and thereby separating the upper and lower portions of the string of tubing.

25. The wellbore system of claim 18, further comprising a tubing recovery system extendable within the wellbore and including:

a release device extendable within the string of tubing and having a body with one or more explosives disposed thereon; and a sacrificial inner sleeve arranged within the string of tubing;

an outer sleeve arranged within the string of tubing and having an upper part coupled to an upper portion of the string of tubing and a lower part coupled to a lower portion of the string of tubing; and a castellated joint coupling the upper and lower parts of the outer sleeve, wherein detonation of the one or more explosives severs the sacrificial inner sleeve and an axial load applied on the string of tubing separates the upper and lower portions at the castellated joint.

26. The wellbore system of claim 18, wherein the at least one device is at least one of a fluid pressure pulse generating device and an acoustic transmitter.

* * * * *